US006612440B1

(12) United States Patent
Agulnik

(10) Patent No.: US 6,612,440 B1
(45) Date of Patent: Sep. 2, 2003

(54) BANANA PROTECTIVE DEVICE

(76) Inventor: David B. Agulnik, P.O. Box 19137 4th Ave. Postal Outlet, Vancouver BC (CA), V6K 4R8

( * ) Notice: Subject to any disclaimer, the term of this patent is extended or adjusted under 35 U.S.C. 154(b) by 75 days.

(21) Appl. No.: 09/780,001

(22) Filed: Feb. 9, 2001

(51) Int. Cl.[7] ..... B65D 85/34
(52) U.S. Cl. ..... 206/521.2; 426/106; 220/4.23
(58) Field of Search ..... 206/521.2, 318, 206/448, 457; 426/106; 220/4.23, 367.1

(56) References Cited

U.S. PATENT DOCUMENTS

| | | | | | |
|---|---|---|---|---|---|
| 857,435 | A | | 6/1907 | Bell | |
| 1,120,296 | A | | 12/1914 | Field | |
| 1,499,183 | A | * | 6/1924 | Morrison | 206/457 |
| 1,647,536 | A | * | 11/1927 | Miller | 408/88 |
| 3,795,265 | A | | 3/1974 | Schurman et al. | |
| 4,187,639 | A | | 2/1980 | Ono | |
| D272,029 | S | | 1/1984 | Grusin | |
| 4,703,519 | A | * | 10/1987 | Krenzel | 383/97 |
| 5,209,345 | A | * | 5/1993 | Haugabook | 206/457 |
| D390,104 | S | * | 2/1998 | Owen | D9/329 |
| 5,862,930 | A | * | 1/1999 | Orkisz | 220/4.23 |
| 5,974,729 | A | | 11/1999 | Clark | |
| 6,092,707 | A | * | 7/2000 | Bowes, Jr. | 224/435 |
| D442,031 | S | * | 5/2001 | Perez | D7/628 |

* cited by examiner

*Primary Examiner*—Mickey Yu
*Assistant Examiner*—Troy Arnold

(57) ABSTRACT

A banana protective device for storing and transporting a banana carefully. The banana protective device includes a container having a first cover member and a second cover member being hingedly attached to the first cover member and being adapted to store a banana therein; and also includes pad members being securely disposed upon the first and second cover members for protecting and cushioning the banana; and further includes fastening members being attached to the first and second cover members for fastenably closing the first and second cover members together.

1 Claim, 2 Drawing Sheets

BANANA PROTECTIVE DEVICE

BACKGROUND OF THE INVENTION

1. Field of the Invention

The present invention relates to a banana guard and more particularly pertains to a new banana protective device for storing and transporting a banana carefully.

2. Description of the Prior Art

The use of a banana guard is known in the prior art. More specifically, a banana guard heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5.974,729; 1,120,296; 857,435; 4,187,639; 3,795,265; and U.S. Pat. No. Des. 272,029.

While these devices fulfill their respective, particular objectives and requirements, the aforementioned patents do not disclose a new banana protective device. The inventive device includes a container having a first cover member and a second cover member being hingedly attached to the first cover member and being adapted to store a banana therein; and also includes pad members being securely disposed upon the first and second cover members for protecting and cushioning the banana; and further includes fastening members being attached to the first and second cover members for fastenably closing the first and second cover members together.

In these respects, the banana protective device according to the present invention substantially departs from the conventional concepts and designs of the prior art, and in so doing provides an apparatus primarily developed for the purpose of storing and transporting a banana carefully.

SUMMARY OF THE INVENTION

In view of the foregoing disadvantages inherent in the known types of banana guard now present in the prior art, the present invention provides a new banana protective device construction wherein the same can be utilized for storing and transporting a banana carefully.

The general purpose of the present invention, which will be described subsequently in greater detail, is to provide a new banana protective device which has many of the advantages of the banana guard mentioned heretofore and many novel features that result in a new banana protective device which is not anticipated, rendered obvious, suggested, or even implied by any of the prior art banana guard, either alone or in any combination thereof.

To attain this, the present invention generally comprises a container having a first cover member and a second cover member being hingedly attached to the first cover member and being adapted to store a banana therein; and also includes pad members being securely disposed upon the first and second cover members for protecting and cushioning the banana; and further includes fastening members being attached to the first and second cover members for fastenably closing the first and second cover members together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar: as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new banana protective device which has many of the advantages of the banana guard mentioned heretofore and many novel features that result in a new banana protective device which is not anticipated, rendered obvious, suggested, or even implied by any of the prior art banana guard, either alone or in any combination thereof.

It is another object of the present invention to provide a new banana protective device which may be easily and efficiently manufactured and marketed.

It is a further object of the present invention to provide a new banana protective device which is of a durable and reliable construction.

An even further object of the present invention is to provide a new banana protective device which is susceptible of a low cost of manufacture with regard to both materials and labor, and which accordingly is then susceptible of low-prices of sale to the consuming public, thereby making such banana protective device economically available to the buying public.

Still yet another object of the present invention is to provide a new banana protective device which provides in the apparatuses and methods of the prior art some of the advantages thereof, while simultaneously overcoming some of the disadvantages normally associated therewith.

Still another object of the present invention is to provide a new banana protective device for storing and transporting a banana carefully.

Yet another object of the present invention is to provide a new banana protective device which includes a container having a first cover member and a second cover member being hingedly attached to the first cover member and being adapted to store a banana therein; and also includes pad members being securely disposed upon the first and second cover members for protecting and cushioning the banana;

and further includes fastening members being attached to the first and second cover members for fastenably closing the first and second cover members together.

Still yet another object of the present invention is to provide a new banana protective device that keep a banana fresh, appealing, and appetizing.

Even still another object of the present invention is to provide a new banana protective device that prevents a banana from becoming bruised.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
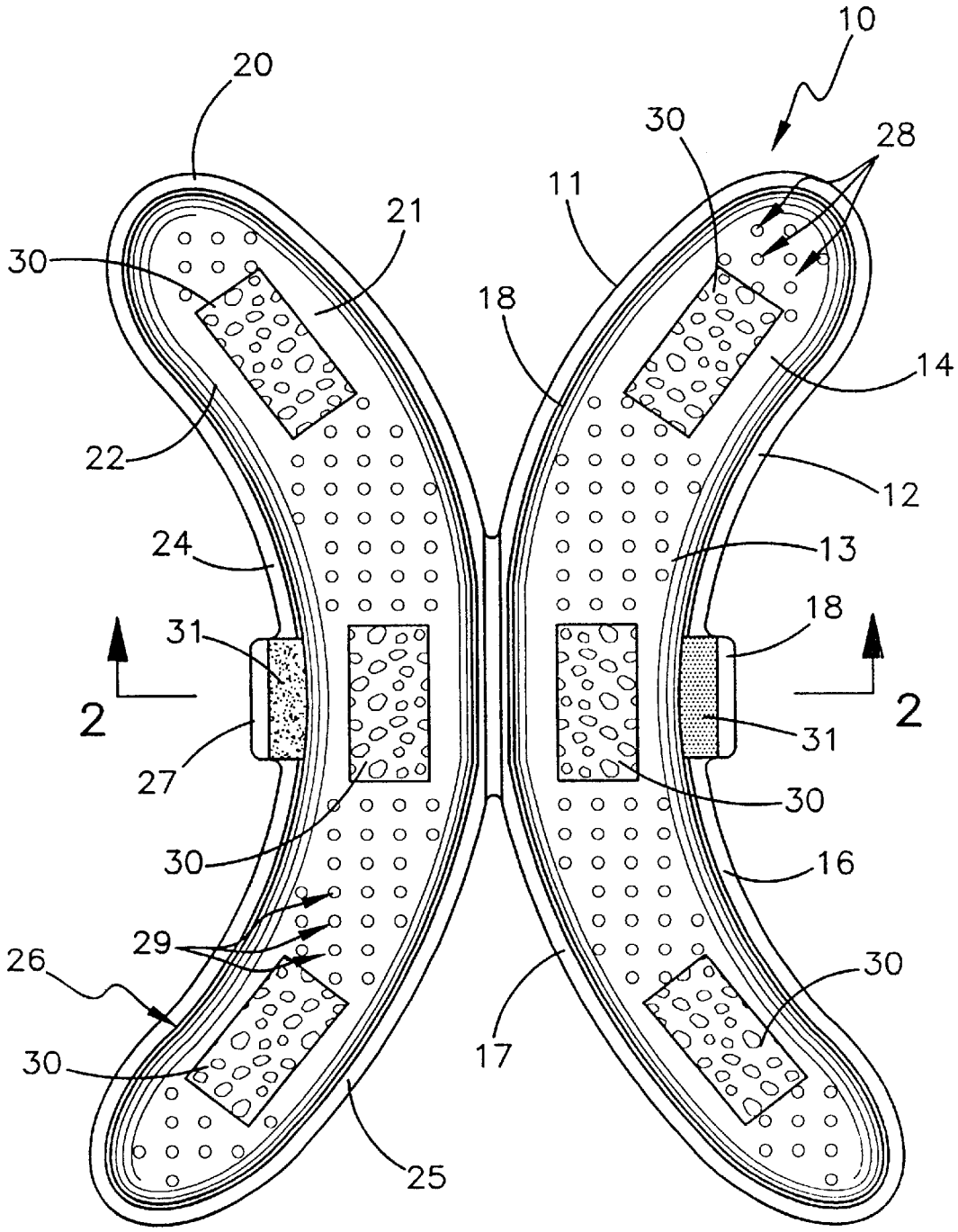
FIG. 1 is a top plan view of a new banana protective device according to the present invention.
Figure 2:
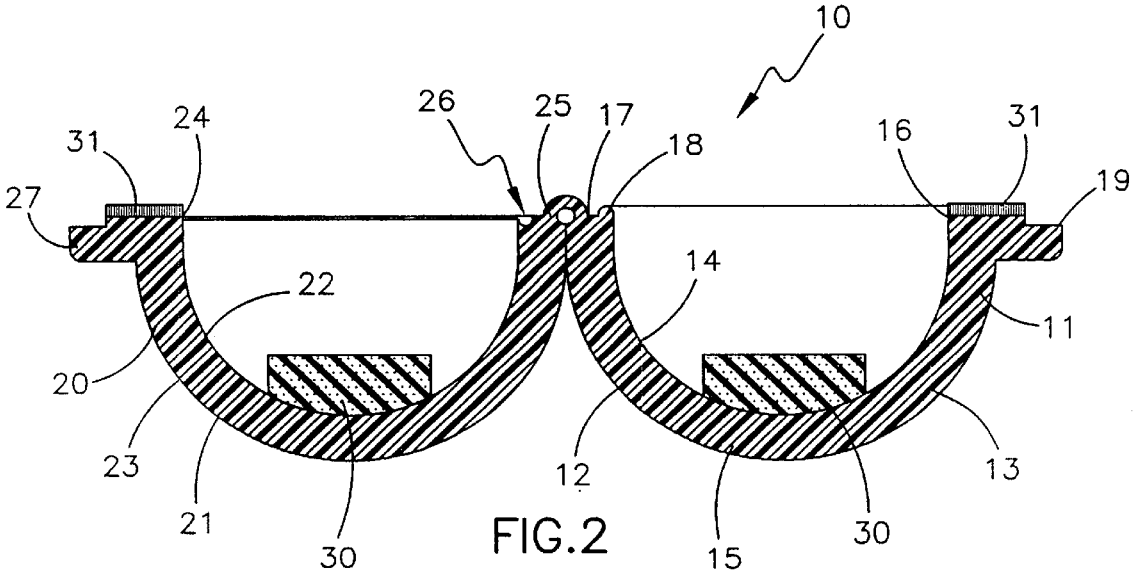
FIG. 2 is a lateral cross-sectional view of the present invention.
Figure 3:
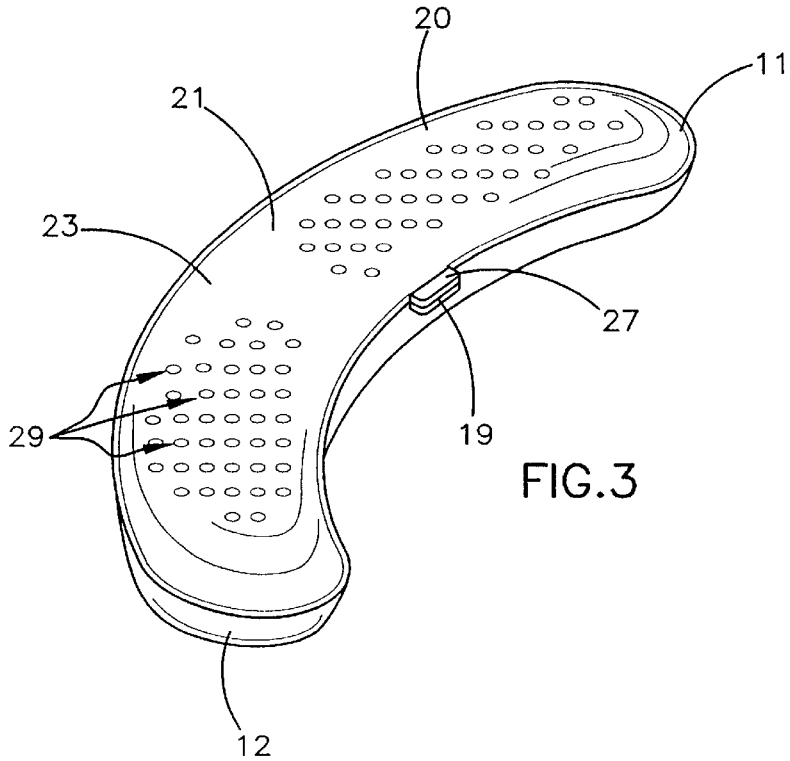
FIG. 3 is a perspective view of the present invention.

With reference now to the drawings, and in particular to FIGS. 1 through 3 thereof, a new banana protective device embodying the principles and concepts of the present invention and generally designated by the reference numeral 10 will be described.

As best illustrated in FIGS. 1 through 3, the banana protective device 10 generally comprises a container 11 having a first cover member 12 and a second cover member 10 being hingedly and conventionally attached to the first cover member 12 and being adapted to store a banana therein. Each of the first and second cover members 12,20 has an elongate wall 13,21 which has a lateral U-shaped cross-section and which is longitudinally curved and banana-shaped. Each of the elongate walls 13,21 further has an inner side 14,22 and an outer side 15,23. Each of the elongate walls 13,21 also has an inner curved longitudinal edge 16,24 and an outer curved longitudinal edge 17,25. The elongate walls 13,21 are hingedly attached along the outer curved longitudinal edges 17,25. Each of the first and second cover members 12,20 further has a fastener support member 19,27 being conventionally attached to a respective inner longitudinal edge 19,27 and extending outwardly therefrom. Each of the fastener support members 19,27 is generally a plate-like ledge. Each of the elongate walls 13,21 has a plurality of perforations 28,29 being spaced about and being disposed therethrough. The first cover member 12 also includes an elongate rib 18 being conventionally disposed upon the outer curved longitudinal edge 17,25 thereof, and the second cover member includes an elongate groove 26 being disposed in the outer curved longitudinal edge 17,25 thereof and being adapted to receive the elongate rib 18. Each of the first and second cover members 12,20 has a length of approximately 10 inches and a width of approximately 1 ½ to 2 inches.

Pad members 30 are securely and conventionally disposed upon the first and second cover members 12,20 for protecting and cushioning the banana. The pad members 30 are made of foam material and are spaced apart and are securely attached to the inner sides 14,22 of the elongate walls 13,21 to cushion and support the banana in the container 12. Fastening members 31 are conventionally attached to the first and second cover members 12,20 for fastenably closing the first and second cover members 12,20 together with the fastening members 31 being strips of hook and loop fasteners being securely attached upon the ledges 19,27 of the first and second cover members 12,20 and being attachable to one another to close the first and second cover members 12,20 upon one another and about the banana.

In use, the user opens the container 10 and places a banana inside thereof and closes the container 10 to allow the user to carry the banana in a safe manner so that it remains fresh and is protected from becoming bruised.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A banana protective device comprising:

a container having a first cover member and a second cover member being hingedly attached to said first cover member, said first and second cover members defining an interior for receiving and storing a banana therein, each of said first and second cover members having a substantially concave inner side;

pad members each being mounted on the inner side of one of said first and second cover members for protecting and cushioning the banana when the banana is received in said interior; and fastening members being attached to said first and second cover members for fastenably closing said first and second cover members together;

wherein each of said first and second cover members has an elongate wall which has a lateral U-shaped cross-section and which is longitudinally curved and banana-shaped, each of said elongate walls further having an outer side;

wherein each of said elongate walls has an inner curved longitudinal edge and an outer curved longitudinal edge, said elongate walls of said first and second cover members being hingedly attached along said outer curved longitudinal edges;

wherein each of said first and second cover members further has a fastener support member being attached to a respective said inner longitudinal edge and extending outwardly therefrom, each of said fastener support members comprising a ledge;

wherein each of said elongate walls has a plurality of perforations being spaced about and being disposed therethrough;

wherein said first cover member includes an elongate rib being disposed upon said outer curved longitudinal edge thereof, and said second cover member includes an elongate groove being disposed in said outer curved longitudinal edge thereof and being adapted to receive said elongate rib;

wherein said pad members are made of foam material and are spaced apart along said inner sides of said elongate walls to cushion and support the banana in said container;

wherein said fastening members are strips of hook and loop fasteners being attached upon said ledges of said first and second cover members and being attachable to one another to close said first and second cover members upon one another and about the banana.

* * * * *